United States Patent [19]

Hattori

[11] Patent Number: 4,810,117

[45] Date of Patent: Mar. 7, 1989

[54] PRINTER WITH A RIBBON LIFT MECHANISM HAVING SELECTIVE TIME INTERVALS EITHER IN TYPEWRITER MODE OR IN PRINTER MODE

[75] Inventor: Yuji Hattori, Nagoya, Japan

[73] Assignee: Brother Kogyo Kabushiki Kaisha, Japan

[21] Appl. No.: 22,957

[22] Filed: Mar. 6, 1987

[30] Foreign Application Priority Data

Mar. 11, 1986 [JP] Japan ..... 61-53330

[51] Int. Cl.[4] ..... B41J 35/20

[52] U.S. Cl. ..... 400/212; 400/208; 400/697.1; 400/704

[58] Field of Search ..... 400/54, 211, 212, 194, 400/195, 196, 196.1, 207, 208, 208.1, 215, 2, 697.1, 704

[56] References Cited

U.S. PATENT DOCUMENTS

| | | | |
|---|---|---|---|
| 3,354,372 | 11/1967 | Beasley | 400/54 X |
| 3,753,004 | 8/1973 | Dominic | 400/54 X |
| 4,053,043 | 10/1977 | Deetz | 400/212 X |
| 4,196,666 | 4/1980 | Kobayashi et al. | 400/212 X |
| 4,247,210 | 1/1981 | Kacmarcik et al. | 400/208 X |
| 4,502,802 | 3/1985 | Kuzuya | 400/212 |
| 4,589,788 | 5/1986 | Lendl | 400/212 X |
| 4,616,946 | 10/1986 | Murata et al. | 400/704 |

FOREIGN PATENT DOCUMENTS

| | | | |
|---|---|---|---|
| 156359 A | 10/1985 | European Pat. Off. | 400/212 |
| 2511138 | 9/1976 | Fed. Rep. of Germany | 400/212 |
| 0051479 | 3/1982 | Japan | 400/54 |
| 60-64884 | 4/1985 | Japan | 400/212 |
| 60-201981 | 10/1985 | Japan | 400/212 |
| 0016881 | 1/1986 | Japan | 400/212 |
| 2148796 A | 6/1985 | United Kingdom | 400/212 |

*Primary Examiner*—Ernest T. Wright, Jr.

*Attorney, Agent, or Firm*—Parkhurst, Oliff & Berridge

[57] ABSTRACT

A printer having a ribbon lift mechanism for lifting a ribbon from a rest position to a printing position. The printer operates in two different modes, that is, a printer mode in which characters are printed according to the data in a memory and a typewriter mode in which characters are printed according to the data from a keyboard. The ribbon is returned from the printing position to the rest position when no subsequent data comes from the memory within a first preset time interval in the printer mode or when no subsequent data comes from the keyboard within a second preset time interval in the typewriter mode. The second time interval is preset shorter than the first time inteval in order to print successively in the printer mode and to put back the ribbon to the rest position quickly when an operator needs to check the print on a printing paper in the typewriter mode.

4 Claims, 4 Drawing Sheets

PRINTER WITH A RIBBON LIFT MECHANISM HAVING SELECTIVE TIME INTERVALS EITHER IN TYPEWRITER MODE OR IN PRINTER MODE

BACKGROUND OF THE INVENTION

The present invention relates to a printer and more particularly to a printer which can also be used as a typewriter in conjunction with an external device such as a keyboard of a personal computer.

It is known that a printer which moves and stops the printing head for every one character to be printed, such as one having a daisy wheel type, is able to print immediately after each data is inputted from an external device. Therefore, such a printer can be used, for example, as a typewriter by using a keyboard of a personal computer. When the printer has a ribbon lift mechanism, the print ribbon is lifted to a printing position with each character data input from a normal lower rest position. This facilitates the operator to check the print. However, when the character data are continuously inputted, the ribbon is held at the printing position for speedier printing and for longer mechanical life. Unless subsequent printing data is supplied in a preset time interval, the ribbon returns to the rest position.

As far as a typewriter is concerned, a typewriter which has the ribbon lift mechanism and of which the operator can vary the time interval by means of a dial or keys on the keyboard has been disclosed for improvement in adjustment of the time interval according to the degree of the operator's skill in typing, for example in Japanese published unexamined patent applications Nos. 60-64884 and 60-201981. An English patent application claiming priority based on the former application is laid open on June 5, 1985 by No. 2148796A, and an EPC application based on the latter is laid open on Oct. 2, 1985 by No. 156359A.

On the other hand, there is a printer which can be used in two different ways, that is, as an external device of a computer to print out the data or text thereof and as a typewriter to print out the characters inputted from the keyboard connected thereon. In such a printer, both a data transfer rate and a pattern of interval variation between data are different between the case when the data are inputted from a memory of the computer and the case when the data are inputted from the keyboard. The data transfer rate when the data come from an external computer device or when they come from a memory is far greater than when they come from a manually operated keyboard.

Further, the difference in the patterns of the interval variation between the above-mentioned two cases is too remarkable to be disregarded. More particularly, the intervals are always the same in every occasion when the data are inputted from the memory of the computer, while the intervals differs depending on many factors when the data are inputted from the keyboard by the operator; that is, the interval between characters within a word is generally shorter than that between words, which is generally shorter than that between sentences. Therefore, it is required to vary the time interval from the time point the last character data is inputted to the time point the printing ribbon is shifted down to the rest position corresponding to a data supply source device connected to the printer mechanism.

SUMMARY OF THE INVENTION

In view of the prior art described above including the disadvantages and shortcomings thereof, it is an object of the present invention to provide a printer with a ribbon lift mechanism which can execute printing without slowing down the printing speed when used as an ordinary printer, and which enables an operator to check the print without waiting by returning the ribbon to the rest position after a short preset time interval when used as a typewriter. Besides, it is another object of the present invention to provide a printer which can automatically set the time interval at a shorter time interval when the external data supply device is a keyboard and at a longer time interval when the external data supply device is a memory device of a computer. Still another object is to provide a printer with a typewriter mode, a store mode and a printer mode whose ribbon lift mechanism automatically works suitably for each of the typewriter mode and the printer mode.

This object is attained by a printer connectible to an external data supply device for printing characters on a printing paper which includes: a ribbon lift mechanism for lifting a ribbon from a rest position to a printing position; a printing head for printing characters on the printing paper via the ribbon; and control means responsive to character data from the external data supply device for driving the ribbon lift mechanism to lift the ribbon to the printing position, for driving the printing head to print the corresponding character on the printing paper via the ribbon, and for driving the ribbon lift mechanism to return the ribbon to the rest position when no subsequent data comes from the external device after a preset time interval; and the improvement is that the preset time interval is made shorter when the external data supply device is a keyboard than when the external data supply device is a memory device storing a plurality of character data.

The object is also attained by a typewriter with a keyboard, a printing section and a memory, operable in three modes; the first being a typewriter mode in which every character is printed by the printing section on a printing paper directly with an operation on the keyboard, the second being a store mode in which code data corresponding to an operation on the keyboard is stored in the memory, and the third being a printer mode in which the code data stored in the memory are printed by the printing section on a printing paper. The printing section of the typewriter includes: a ribbon lift mechanism for lifting the ribbon from a rest position to a printing position; a printing head for printing characters on the printing paper via the ribbon; and control means responsive to character data from the keyboard or from the memory for driving the ribbon lift mechanism to lift the ribbon to the printing position, for driving the printing head to print the corresponding character on the printing paper via the ribbon, and for driving the ribbon lift mechanism to return the ribbon to the rest position when no subsequent data comes from the memory after a first preset time interval in the printer mode or when no subsequent data comes from the keyboard after a second preset time interval in the typewriter mode, the second time interval being shorter than the first time interval.

BRIEF DESCRIPTION OF THE DRAWINGS

The invention will now be described in more detail, by way of example and with reference to the accompanying drawings, in which.

DESCRIPTION OF THE PREFERRED EMBODIMENT

Figure 2:
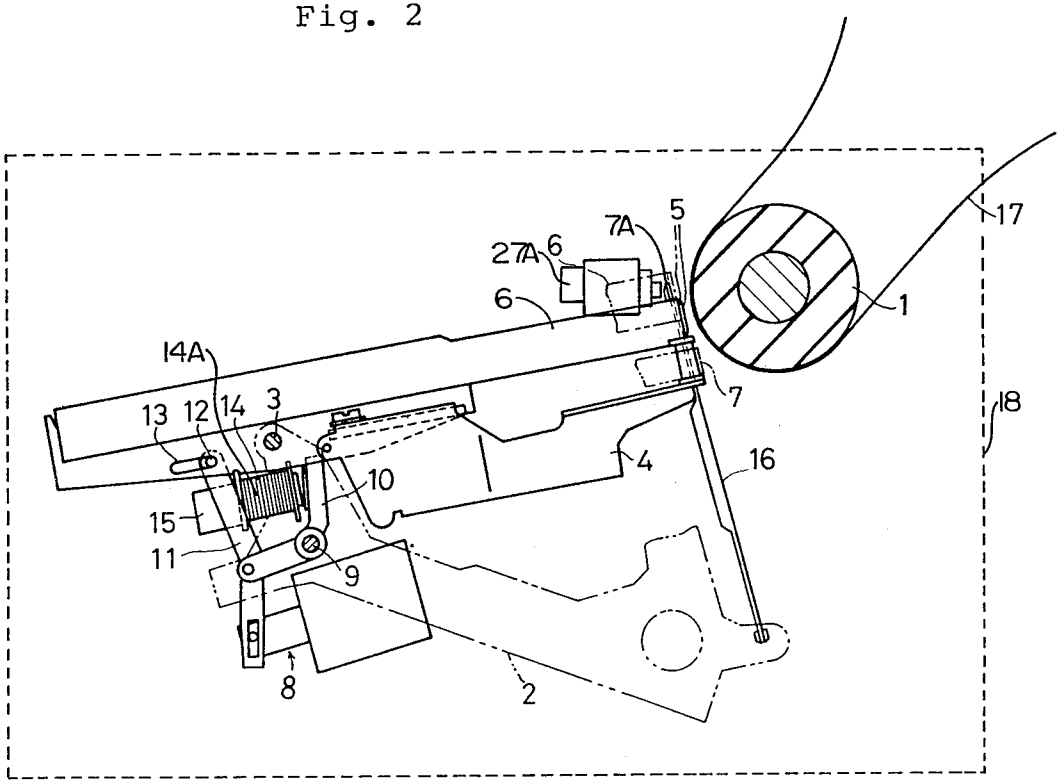
FIG. 2 is a side view of the main portion of the carriage of the printer.

Hereafter a preferred embodiment of the invention will be described in detail according to the drawings. Referring to FIG. 2, a platen 1 is rotatably supported on a frame 18 of a printer. A carriage 2 is supported in front of the platen 1 to be movable along the longitudinal direction of the platen 1. A supporting shaft 3 is secured by penetrating the front upper part of the carriage 2. At the central part of the supporting shaft 3, a holder 4 is supported to be shifted vertically. A ribbon cassette 6 containing a printing ribbon 5 is removably mounted on the upper surface of the holder 4. The printing ribbon 5 running through the ribbon cassette 6 has an exposed portion which faces the platen 1. A correction ribbon 7 is attached below the printing ribbon 5 and faces the platen 1, and a lift mechanism 8 is provided for the correction ribbon 7. The design of the lift mechanism 8 is the same as that disclosed in the U.S. Pat. No. 4,502,802.

A lifting shaft 9 penetrates the carriage 2 below the supporting shaft 3. An L-shaped first lever 10 is supported at its center swingably around the central part of the lifting shaft 9. The lever 10 is normally positioned as shown in FIG. 2. A second lever 11 is pivotally supported at one end of the first lever 10. An engaging pin 12 projects from one end of the second lever 11. A slot 13 is located longitudinally of the side surface of the holder 4. The engaging pin 12 of the second lever 11 is received in the slot 13.

The slot 13 functions as a cam groove for the engaging pin 12 which rotates around the lifting shaft 9. The combination of the slot 13 and the engaging pin 12 constitutes a coupling mechanism for movably coupling the second lever 11 and the holder 4.

An electromagnet 15 which has a core 14 and a coil 14A wound thereon, is attached to the carriage 2 to be opposite to the upper part of the first lever 10. When the electromagnet 15 is excited, the upper part of the first lever 10 is attracted to the magnet 15 and the first lever 10 rotates counterclockwise. The rotation makes the second lever 11 move downward to rotate the holder 4 counterclockwise on the supporting shaft 3. As a result, the holder 4 lifts the ribbon cassette 6 from the rest position to the printing position which is shown by a double-dots interrupted line in FIG. 2. The printing ribbon 5 and a daisy wheel 16 cooperate to print a desired character on a printing paper 17 which is set on the platen 1.

Figure 1:
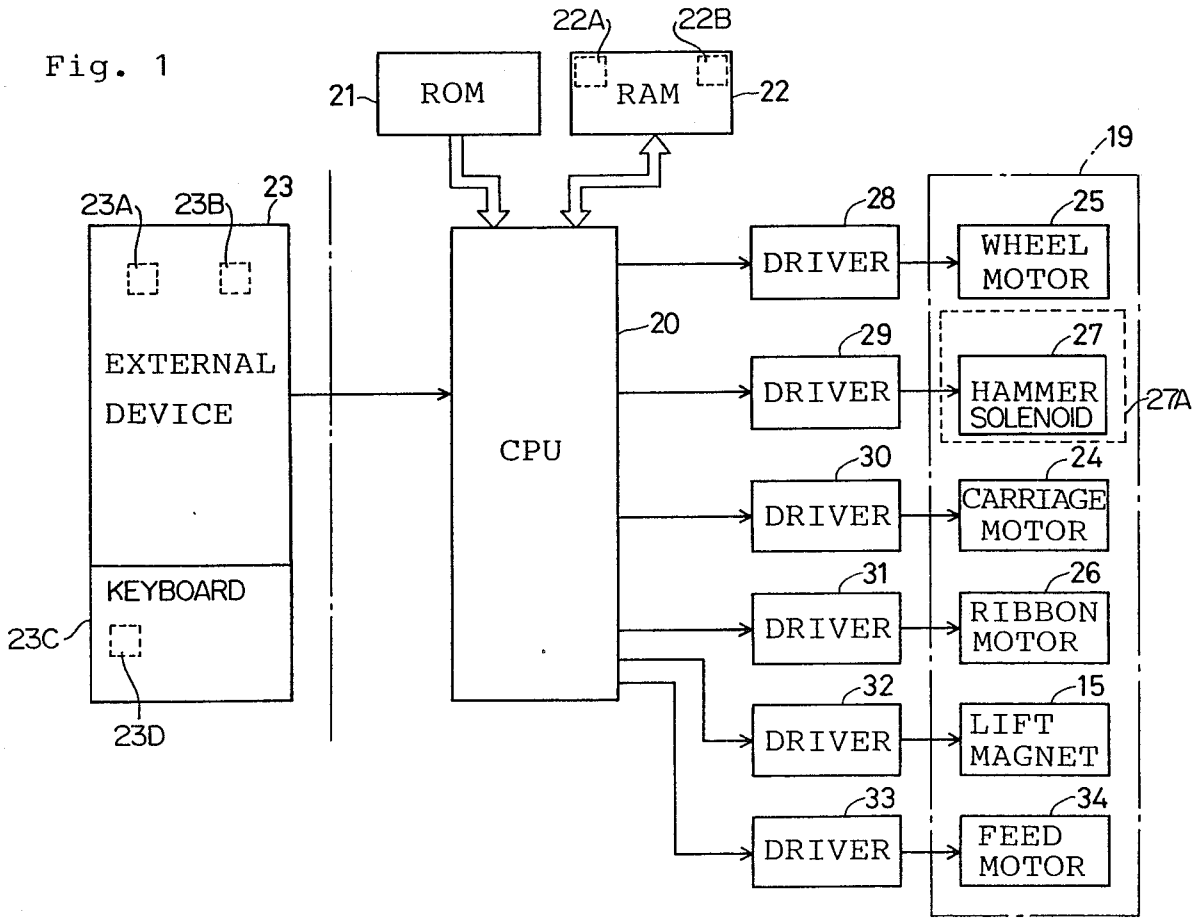
FIG. 1 is a block diagram showing an electric circuit of a printer embodying the invention.

The electrical block diagram of the control section of this printer is shown in FIG. 1. A central processing unit (CPU) 20 as control means is connected with a read only memory (ROM) 21, a random access memory (RAM) 22, and an external device 23. Moreover, the CPU 20 is connected with driver circuits 28, 29, 30, 31, 32 and 33 which correspond respectively to a type-wheel driving motor 25, a hammer solenoid 27, a carriage driving motor 24, a ribbon feeding motor 26, the ribbon lifting electromagnet 15 and a line feeding motor 34 in a printing mechanism 19.

The ROM 21 stores control programs for controlling the entire printer including, for example: a control program for controlling respectively the motors 24, 25, 26 and 34, the solenoid 27 and the electromagnet 15 in response to the character code data inputted from the external device 23; and a control program for controlling respectively the motors 24, 25, 26 and 34, the solenoid 27 and the electromagnet 15 in response to each function control code data inputted from the external device 23. When the CPU 20 receives printer mode code data from the external device 23, it controls the printing mechanism 19 according to the control program prepared for the printer mode stored in the ROM 21. Alternatively, when the CPU 20 receives typewriter mode code data from the external device 23, it controls the printing mechanism 19 according to the control program prepared for the typewriter mode stored in the ROM 21.

The RAM 22 comprises an input buffer memory 22A for temporarily storing various data inputted from the external device 23 and a work memory 22B temporarily storing any results computed by the CPU 20. In order to control the printing mechanism 19, the CPU 20 interprets various code data which are inputted from the external device 23 by the control program read out from the ROM 21. Then, the CPU 20 outputs control signals which correspond to the inputted printing data to the drivers 28 through 33 in the printing mechanism 19.

The process of controlling the printing mechanism 19 according to an inputted character data will be described hereinafter. First, the CPU 20 outputs a control signal to the electromagnet driver 32 from which a drive current is generated to excite the electromagnet 15. The excitation of the magnet 15 causes the lift of the printing ribbon 5 to the upper printing position by way of the first lever 10, the second lever 11 and the holder 4. Second, the CPU 20 outputs a control signal to the type-wheel driver 28 from which a drive current is generated to the type-wheel driving motor 25 so as to rotate it. By the rotation of the motor 25, a type face 7A on the type wheel 16 corresponding to the character data is positioned to the print position in front of a printing hammer 27A. Third, the CPU 20 outputs a control signal to the hammer driver 29 from which a drive current is generated to the hammer solenoid 27, and then the type face 7A on the type wheel 16 is hit by the printing hammer 27A to print the corresponding character on the printing paper 17 via the ribbon 5. The carriage driver 30 then generates a drive current to the carriage driving motor 24 to rotate it for a definite amount, and the rotation of the motor 24 moves the carriage 2 rightward by one character spacing. The ribbon feeding motor driver 31 generates a drive current to the ribbon feeding motor 26 to rotate it for a definite amount, and the rotation of the motor 26 feeds the printing ribbon 5 by a preset distance.

In the typewriter mode, the CPU 20 processes a return code signal inputted from the external device 23 by a control program read out from the ROM 21, and outputs control signals both to the carriage driver 30 and to the line feeding motor driver 33. As a result, a drive current is generated to the carriage driving motor 24 to reversely rotate it. The rotation of the motor 24 puts the carriage 2 back to a preset left margin position. Simultaneously the line feeding motor driver 33 generates a drive current to the line feeding motor 34 to rotate it so as to feed the printing paper 17 by a preset line spacing.

The external device 23 is provided with a host CPU 23A, a memory 23B and a keyboard 23C as an input device. The keyboard 23C is provided with a mode selector key 23D in order to select any one of three modes, that is, a store mode, a printer mode and a typewriter mode. When the store mode is selected by means of the mode selector key 23D, the host CPU 23A stores the printing data, which is inputted by key operation on the keyboard 23C, in the memory 23B of the device 23 according to a control program stored therein.

When a printer mode is selected by means of the mode selector key 23D, the host CPU 23A of the external device 23 sends the printer mode code data to the CPU 20 of the printer before sending printing data stored in the memory 23B of the external device 23.

When a typewriter mode is selected by means of the mode selector key 23D, the host CPU 23A of the external device 23 sends the typewriter mode code data to the CPU 20 of the printer before sending printing data stored in the memory 23B of the external device 23.

Referring to the printer that has been described above, its function will be described hereinafter with regard to the ribbon lift timing.

Figure 3:
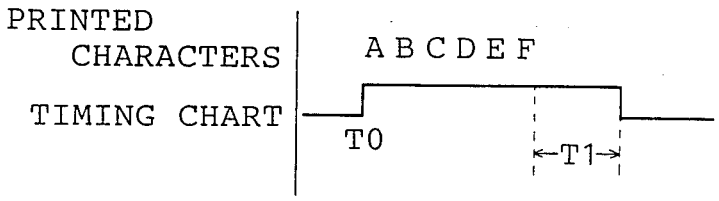
FIG. 3 is a timing chart of the electromagnet in a print mode.

If printing is required according to the printing data which has been previously stored in the memory 23B of the external device 23 in the store mode, the printer mode is selected by means of the mode selector key 23D. Then, the host CPU 23A outputs to the CPU 20 the printer mode code data and the printing data according to the control program in the memory 23B. The CPU 20 then processes the printer mode code data and starts the control program for printer mode stored in the ROM 21. Namely, when the CPU 20 receives the printing data from the external device 23, it excites the electromagnet 15 to cause the lift of the printing ribbon 5 to the printing position at a time point T0 shown in FIG. 3, and also drives the motors 24, 25, 26 and 34 and the solenoid 27 to execute printing according to the respective control data. Unless a subsequent printing data is supplied to the CPU 20 from the external device 23 within a first time interval T1, which is preset in the control program, after the print operation based on the latest printing data, the CPU 20 generates a control signal to the electromagnet driver 32 at the moment the time interval T1 has passed. At this time the electromagnet 15 is released from excitation so as to return the printing ribbon 5 to the rest position and the printing mechanism 19 is to be in preparation for any subsequent printing data being inputted.

Figure 4:
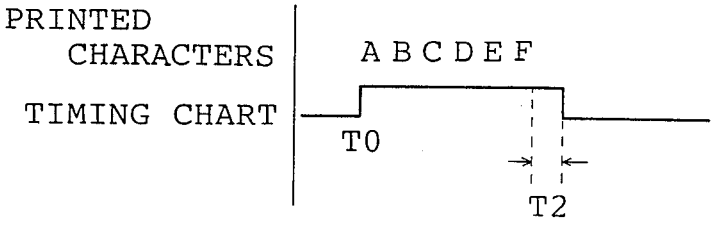
FIG. 4 is a timing chart of the electromagnet in a type mode.

On the other hand, when the typewriter mode is selected by means of the mode selector key 23D, the host CPU 23A outputs to the CPU 20 the typewriter mode code data and the printing data according to the control program in the memory 23B. The CPU 20 processes the typewriter mode code data and starts the control program for typewriter mode stored in the ROM 21. Namely, when the CPU 20 receives the printing data from the external device 23, it excites the electromagnet 15 to cause the lift of the printing ribbon 5 to the printing position at a time point T0 shown in FIG. 4, and also drives the motors 24, 25, 26 and 34 and the solenoid 27 to execute printing according to the respective control data. Unless a subsequent printing data is supplied to the CPU 20 from the external device 23 within a second time interval T2, which is preset in the control program and which is shorter than the first time interval T1, after the print operation based on the latest printing data, the CPU 20 generates a control signal to the electromagnet driver 32 at the moment the time interval T2 has passed, then, the electromagnet 15 is released from excitation so as to return the printing ribbon 5 to the rest position and the printing mechanism 19 is to be in preparation for any subsequent printing data being inputted.

As described above, in the printer mode, this printer is able to increase printing speed, since the printing ribbon 5 is not put back to the rest position on the condition that any subsequent printing data after the latest one is supplied within the rather long first time interval T1 which is longer than the second time interval T2. In the typewriter mode, on the other hand, the printer enables an operator to quickly check the printed characters on the printing paper 17, since the printing ribbon 5 is put back to the rest position unless any subsequent printing data after the latest one is supplied within the rather short second time interval T2. Both the time intervals T1 and T2 are optionally variable within each predetermined range, and may have no common range. Though the printer is connected with a keyboard 23C, as an external data supply device, which cooperates with a personal computer in the above-stated embodiment, the printer embodying the present invention may be connected with a keyboard alone.

Figure 5:
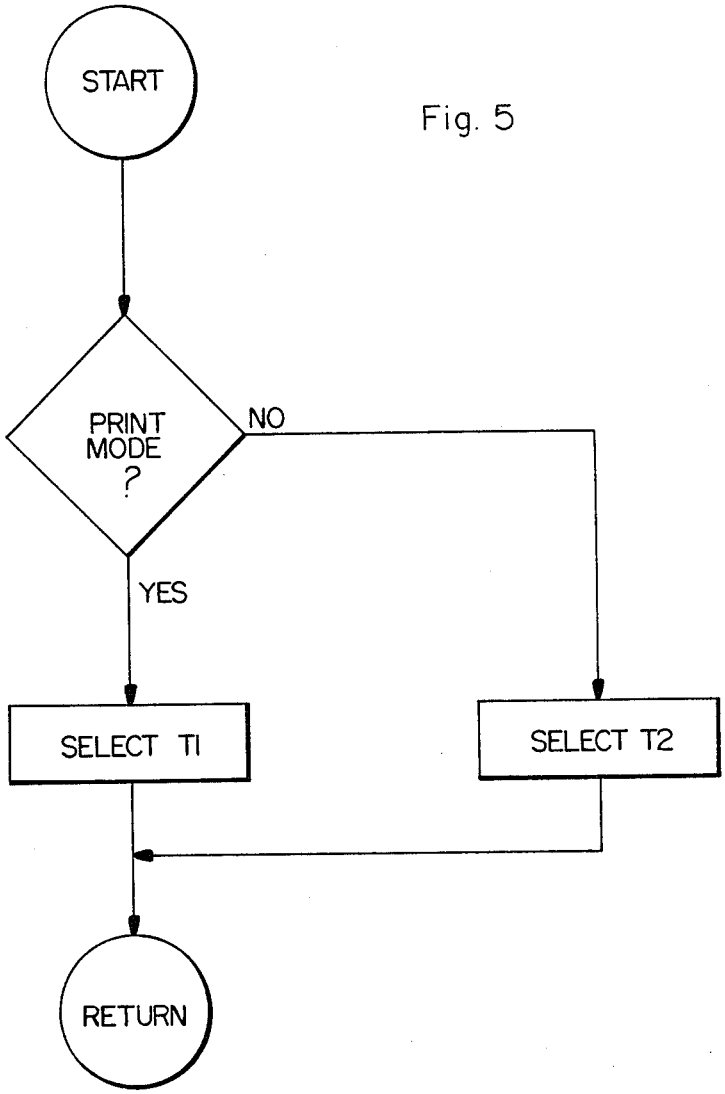
FIG. 5 is a flow chart illustrating one embodiment of the operation of the time interval control means for setting a preset time interval shorter in response to receiving a typewriter mode code than when a printer mode code is received.

FIG. 5 illustrates the operation of the time interval control means for setting a preset time interval shorter in response to receiving a typewriter mode code than when a printer mode code is received. At "START" the printer is placed into a state of readiness for receiving a print mode code. When a mode code is received, the decision block determines whether a print mode has been received. If it is determined that a print mode code has been received, then the time interval control means selects time interval T1, and the printer is placed in a state of readiness to receive character data in "RETURN". If it is determined that a print mode code has not been received, then the time interval control means selects time interval T2, and the printer is placed in a state of readiness to receive character data in "RETURN".

Obviously, many modifications and variations of the present invention, such as an application to a typewriter having a printing section with a ribbon lift mechanism and a memory, are possible with regard to the above teachings. It is therefore to be understood that within the scope of the appended claims, the invention may be practiced other than as specifically described.

What is claimed is:

1. A printer connectible to an external data supply device capable of sending either a printer mode code or a typewriter mode code to said printer for printing characters on a printing paper comprising:

a ribbon lift mechanism for lifting a ribbon from a rest position to a printing position;

a printing head for printing characters on the printing paper via the ribbon; and a print control means responsive to character data from the external data supply device for driving the ribbon lift mechanism to lift the ribbon to the printing position, for driving the printing head to print the corresponding character on the printing paper via the ribbon, and for driving the ribbon lift mechanism to return the ribbon to the rest position when no subsequent data comes form the external device after a preset time interval; and wherein said print control means includes a time interval control means for setting said preset time interval shorter in response to receiving typewriter mode code from said external data supply device than when a printer mode code is received from the external data supply device.

2. A printer according to claim 1, wherein the time interval used when a printer mode code is received is made variable within a first range an the time interval used when a typewriter mode code is received is made variable within a second range, and the first range and the range have no common range.

3. A typewriter with a keyboard, a printing section and a memory, operable in three modes, the first being a typewriter mode in which every character is printed by the printing section on a printing paper directly with an operation on the keyboard, the second being a store mode in which code data corresponding to an operation on the keyboard is stored in the memory, and the third being printer mode in which the code data stored int he memory are printed by the printing section on a printing paper, wherein the printing section comprises:

a ribbon lift mechanism for lifting a ribbon from a rest position to a printing position;

a printing head for printing characters on the printing paper via the ribbon; and a print control means responsive to character data from the keyboard or from the memory for driving the ribbon lift mechanism to lift the ribbon to the printing position, for driving the printing head to print the corresponding character on the printing paper via the ribbon, and for driving the ribbon lift mechanism to return the ribbon to the rest position when no subsequent data comes from the memory after a preset time interval; and including a time interval control means responsive to the operated modes for setting a first preset time interval as the preset time interval in the printer mode and for setting a second time interval which is shorter than the first time interval as the preset time interval in the typewriter mode.

4. A typewriter according to claim 3, wherein the first time interval in the printer mode is made variable within a first range and the second time interval in the typewriter mode is made variable within a second range, and the first range and the second range have no common range.

* * * * *